United States Patent [19]

Manem

[11] Patent Number: 4,832,221

[45] Date of Patent: May 23, 1989

[54] CAP WITH A SLIDING-FLAP CLOSURE

[76] Inventor: Jacques Manem, 58, route d'Herbeville, F 78580 Maule, France

[21] Appl. No.: 101,207

[22] Filed: Sep. 25, 1987

[30] Foreign Application Priority Data

Oct. 27, 1986 [FR] France ..... 86 14875

[51] Int. Cl.[4] ..... B65D 3/00

[52] U.S. Cl. ..... 215/237; 220/348; 222/511

[58] Field of Search ..... 215/235, 237, 307, 322; 220/254, 264, 345, 346, 348; 222/511, 512, 546, 561

[56] References Cited

U.S. PATENT DOCUMENTS

| | | | |
|---|---|---|---|
| 1,613,518 | 1/1927 | Kendall | 222/511 |
| 1,730,870 | 10/1929 | Wilson | 222/511 |
| 1,980,049 | 11/1934 | Gainer | 222/511 |
| 2,245,523 | 6/1941 | Bernhardt | 222/511 |
| 3,363,798 | 1/1968 | Garangiotis | 220/345 X |
| 3,527,373 | 9/1970 | Giraudet et al. | 220/345 |
| 3,792,803 | 2/1974 | Kessler | 222/511 |
| 4,127,212 | 11/1978 | Waterbury | 220/254 |
| 4,170,724 | 10/1979 | Waterbury | 229/345 X |
| 4,570,817 | 2/1986 | Hambleton et al. | 220/345 |

*Primary Examiner*—Stephen Marcus
*Assistant Examiner*—Nova Stucker
*Attorney, Agent, or Firm*—Rodgers & Rodgers

[57] ABSTRACT

This cap is intended especially for a bottle or a container with a neck and is designed to be fastened to the latter in the conventional way by means of a thread or as a result of force-fitting and for this purpose has relative to the neck an outer skirt (1) and an inner skirt (2). According to the invention, this cap is provided with a pouring orifice (3) which can be closed sealingly and opened so as to ensure a flow variable on demand, as a result of the sliding movement of a flap (5) held laid against it by means of a slideway and fixed to the top (4) of the cap on the opposite side (8) to the pouring orifice (3) by means of a folded part (7) which is retractable and concealable as a result of finger operation.

7 Claims, 2 Drawing Sheets

CAP WITH A SLIDING-FLAP CLOSURE

The present invention relates to a cap, especially for a bottle or a container with a neck, equipped with a sliding-flap closure. More particularly, it relates to a cap for a threaded neck or intended for engaging sealingly on the latter, this cap being provided with a pouring orifice which can be closed sealingly and opened so as to ensure a flow variable on demand, as a result of the sliding movement of a flap held laid against it by means of a slideway and fixed to the top of the cap on the opposite side to the pouring orifice by means of a folded part which is retractable and concealable as a result of finger operation.

In the current technique used for capping bottles or containers with a neck, which are intended to contain particularly Liquid cosmetic products or powdered products, there are many known types of cap having a small round pouring orifice making it possible to release the content of the bottle or container in question, usually in the form of a stream of constant flow, and this orifice can be opened or closed on demand by tipping a flap which is mounted on a hinge and which very often forms the casing of the cap.

These known types of cap are mostly the subject of criticism by their users, usually for three main reasons: the size of the pouring orifice which is too small, with the result that it becomes choked very quickly, the impossibility of varying the flow of the product contained, and the unreliable sealing of the closure causing deposits of the product which make it difficult for the user to open it again and/or close it.

The present invention is designed to eliminate most of these serious disadvantages by providing a cap equipped with a pouring orifice of maximum size according to the size of this cap, and with a sliding-flap closure on this orifice which is sufficiently sealed in the closing position and can open to a greater or lesser extent under the translational force exerted by a finger, in order to select the desired flow of the product contained in the bottle or the container carrying this cap.

According to the invention, such a cap designed in a known way to be fastened by means of a thread or as a result of force-fitting on the neck of a bottle or container and having a large-size pouring orifice made in its top is notable in that it is equipped with a closure in the form of a flap laid against this orifice, this flap comprising a tongue, the free front end of which is designed to be capable of sliding longitudinally, at the same time being guided and pressed onto the orifice by means of slide tracks or slideways lateral relative to the latter, and the rear end of which is held fixed to the top of the cap by means of a part folded in concertina form.

In one embodiment, according to the invention, the pouring orifice is of oblong shape, occupies in terms of length substantially one third of the diameter of the cap and is fitted, on its periphery, with a small projecting lip forming a sealing ring. This pouring orifice can also be made triangular with its corners rounded, the vertex of the triangle being located on the same side as the free end of the tongue and being released first during the progressively variable opening action, the base of this triangle being arranged in front of the folded part and parallel to the folds. The tongue forming the flap is equipped laterally and longitudinally with bevelled lips designed to be engaged into and slide in the lateral slide tracks of corresponding shape, in order to form a type of sliding dovetail joint. To improve the sliding action and the pressure exerted by the tongue on the pouring orifice, this tongue is equipped laterally with double-bevelled lips, the lateral slide tracks projecting in the form of a corresponding V laid on its side. This tongue can also be equipped with a slight lower protuberance which matches the shape of the pouring orifice and which, in the closing position, can engage into the lip or sealing ring of the latter.

Moreover, according to the invention, the rear part of the tongue, folded in concertina form, is arranged so that, in the compressed or close-packed position, it allows the free end of this tongue to expose the pouring orifice completely, and so that, in the position of rest, it nevertheless keeps this tongue in the closing position, without tending to return it to the rear. It will be seen, however, that under this folded part, as it were in order to conceal it during the sliding of the tongue into the opening position, there is, in the top of the cap, a receptacle in the form of a cavity located at the rear of the pouring orifice.

Moreover, to ensure perfect pouring, in this cap there is a form of internal pouring spout which starts at the upper level of the sleeve inside the neck of the bottle or container and which opens out at the edge of the pouring orifice near the corresponding edge of the cap under the free end of the tongue.

In another embodiment, the pouring orifice is preferably round, but can also be made oblong, and in contrast the flap is associated by means of its folded part with a slotted plate which is located above the top of the cap and surmounts it and which keeps it up against the bottom of the slideways, this slotted plate being forcefitted by means of its peripheral edge into an upward-projecting rim on the top of the cap, and its slot being arranged diametrically relative to the latter and being designed to allow the flap to be actuated in a longitudinal sliding movement as a result of finger operation.

Furthermore, this slotted plate is fixed to the top of the cap by means of a hinge part arranged in the extension of the slot on the opposite side to the tongue part of the flap, the folded part of the latter starting from the bottom of this slot, and this slot being provided above this folded part and the tongue part, at the same time having a width slightly less than the width of these.

On the other hand, in order to ensure that the cap is tamper-proof before use, the free end of the tongue is equipped with a tab preventing the return of the latter and intended to be torn off or cut in order to allow the opening action.

Finally, to make the cap even more tamper-proof, it can be equipped with a capsule engaged on it and mounted on a hinge at the rear of the cavity receiving the folded part of the tongue.

Other characteristics of the invention will emerge from the following description of embodiments of this cap which are given as non-limiting examples and which are shown diagrammatically in the accompanying drawings, in which.

Figure 1:
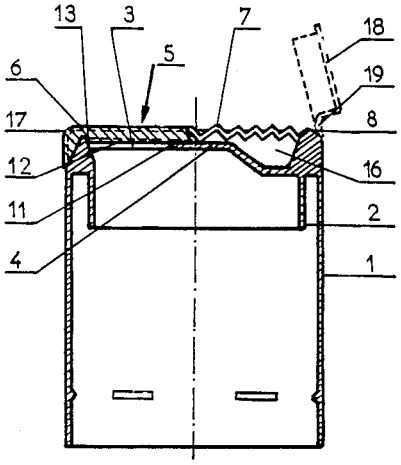
FIG. 1 is a sectional and elevation view of the cap according to one embodiment, taken along the longitudinal centre axis relative to the tongue.
Figure 3:
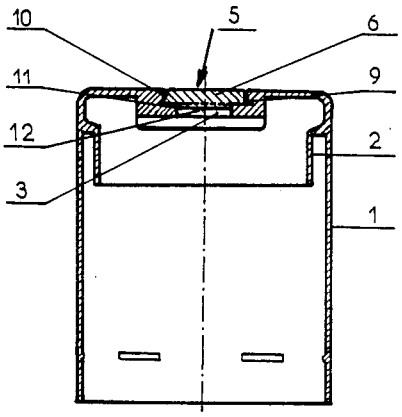
FIG. 3 is a cross-sectional view taken along the line III—III of FIG. 2.

As can be seen from these Figures, the cap according to the invention, shown diagrammatically, is of the conventional type to be force-fitted on the neck of a bottle or of a container, and for this purpose has relative to the neck an outer skirt 1 and an inner skirt 2. According to the invention, it is equipped with an elongate pouring orifice 3 located in its top 4 and closed by means of a flap, designated as a whole by the reference 5, which is designed to be capable of sliding longitudinally. This flap 5 comprises a tongue part 6 covering and projecting beyond the pouring orifice 3 and a rear part 7 folded in concertina form and fixed to the corresponding edge of the cap at 8. The tongue part 6 is equipped laterally with bevelled lips 9 designed to be seated in and slide, in the manner of a sliding dovetail joint, in slide tracks or slideways 10 of corresponding shape which are arranged laterally relative to this tongue and to the pouring orifice 3. The peripheral edge of this orifice is equipped with a thin flexible lip 11 forming a sealing ring, and the tongue part 6 itself has a lower small protuberance or slight bulge 12 having the shape of this orifice 3 and intended to engage in it in a closing position, this bulge being sufficiently small so as not to impede the sliding of the tongue in the position opening or exposing the orifice.

Figure 2:
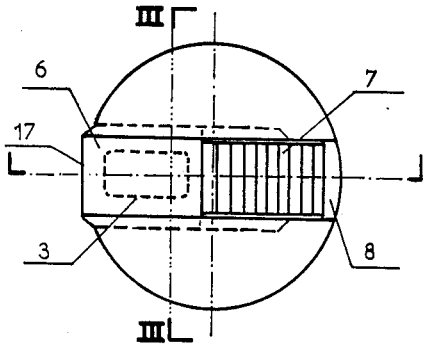
FIG. 2 is a plan view from the top of the cap illustrated in FIG. 1.
Figure 4:
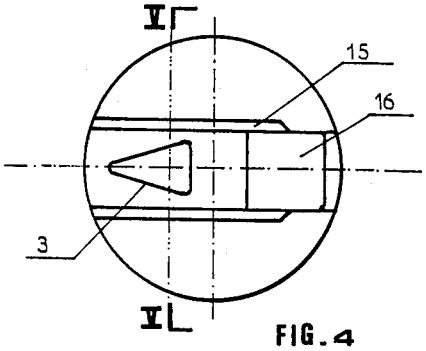
FIG. 4 is a plan view of the cap from the top, the tongue being omitted for easier understanding, according to another form of the pouring orifice.

As can be seen best in FIGS. 2 and 4, the pouring orifice can have a shape which is substantially rectangular (FIG. 2) or triangular (FIG. 4). Moreover, to ensure perfect pouring, a form of pouring spout 13 is provided, this starting at the upper level of the inner sleeve 2 and opening out at the edge of the pouring orifice 3 located very near the corresponding edge of the cap.

Figure 5:
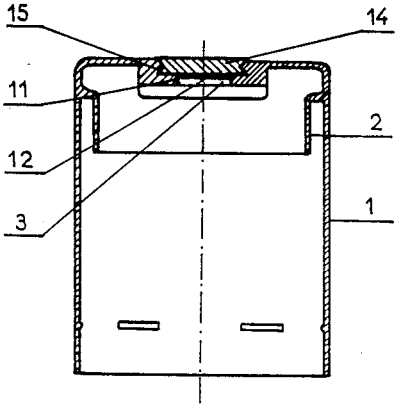
FIG. 5 is a cross-sectional view which, like that of FIG. 3, is taken along the line V—V of FIG. 4, but according to another embodiment of the tongue.

Furthermore, in another embodiment, as can be seen best in FIG. 5, the lateral longitudinal edges of the tongue part 6 are each equipped with two bevelled lips 14 of opposite slopes, engaged slidably in slideways 15 or slide tracks in the form of a V laid horizontally.

On the other hand, a cavity or recess 16 is made in the top of the cap, as can be seen best in FIG. 1, and is located below the rear of the orifice 3 and of the folded part 7, in order to accommodate the latter in the retracted position when the tongue part 6 is put into the opening position.

Figure 6:
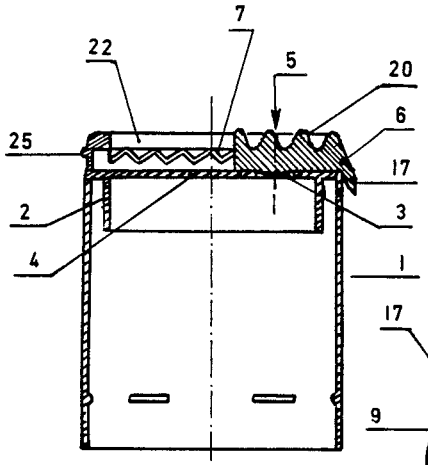
FIG. 6 is a sectional and elevation view of the cap according to another embodiment of the latter, taken in the longitudinal centre axis relative to the tongue.
Figure 7:
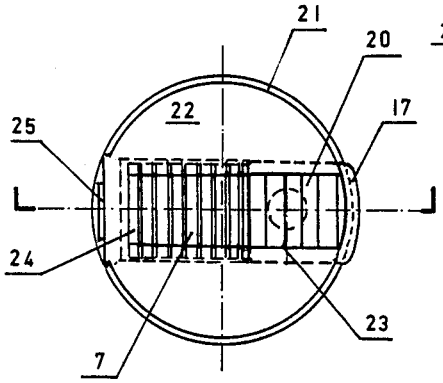
FIG. 7 is a plan view from the top of the cap illustrated in FIG. 6.
Figure 8:
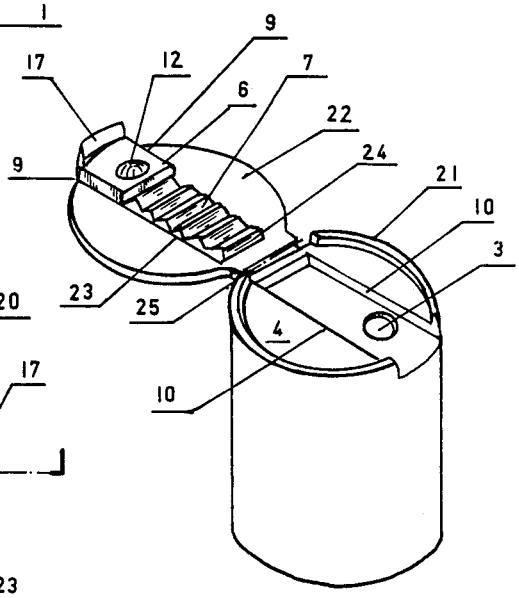
FIG. 8 is a perspective view of the cap illustrated in FIGS. 6 and 7, when it is in the position of removal from the mold.

FIGS. 6 to 8 illustrates another embodiment of the cap according to the invention, particularly as regards the arrangement of the means of closing the pouring orifice 3, that is to say the flap 5 and its rear folded part 7. In this embodiment, as in the preceding embodiments, the cap has relative to the neck of the container an outer skirt 1 and an inner skirt 2. This cap is equipped with a round pouring orifice 3 located in its top 4 and closed by means of the flap 5 which is designed to be capable of sliding longitudinally. This flap comprises a tongue part 6 equipped with upper finger-engaging projections 20 and a rear part 7 folded in concertina form. The tongue part 6 is equipped laterally with bevelled lips 9 designed to be seated in and slide in sideways 10 rebated in the top 4 of the cap. The tongue part 6 is equipped, at the bottom, with a small protuberance 12 which has the shape of the pouring orifice 3 and which is intended to engage into the latter when the flap 5 is in the closing position.

In contrast, in this embodiment, the top 4 of the cap is equipped, substantially peripherally, with a rim 21 projecting upwards and designed to allow the engagement of the edge of an upper slotted plate 22. This plate is designed to keep the tongue part 6 engaged in the slide-ways 10 and prevent the folded part 7 from lifting again during an operation to open the flap 5. For this purpose, the slot 23 in this plate 22 is given a width slightly less than that of the tongue part 6 and of the folded part 7.

It must also be noted, as can be seen best in FIG. 8 showing the cap in the position of removal from the mold, that the rear end 24 of the folded part 7 starts from and is fixed to the bottom of the slot 23 of the plate 22, this being fixed to the top 4 of the cap by means of a hinge part 25.

Furthermore, in order to ensure that the closure is as it were tamper-proof before use, the free end of the tongue part 6 is equipped with a locking tab 17 intended to be torn off or severed at the time of first use. It will also be seen that, to make the cap even more tamper-proof, it can be equipped with a capsule 18, partially represented by broken lines in FIG. 1, which is mounted on a hinge part 19 located at the rear of the rear fastening 8 of the folded part 7.

I claim:

1. A cap with a sliding-flap closure for a container, said cap comprising a pouring orifice, a tongue longitudinally slidable in lateral slideways with the front part thereof in the position of rest covering said pouring orifice, the improvement comprising the rear end of said tongue having a part folded in the form of a concertina, the front end of said folded part being joined to said tongue and the rear end thereof being joined to the top portion of said cap, said folded part comprising folds and being disposed generally in the same plane as said tongue, said folds being arranged generally perpendicular to the axis of said tongue and extending generally transversely to the vertical axis of said container, and said folded part, in the position of rest, keeping said tongue in the closed position and, in the compressed position, allowing said tongue to open said pouring orifice completely, the expansion force of said folded part from its compressed position being insufficient, without manual assistance, to return said tongue to a position closing said pouring orifice.

2. A cap as defined in claim 1 wherein a cover overlies said cap and a slot is disposed in said cover.

3. A cap as defined in claim 2 wherein said plate is joined to said cap by means of a hinge.

4. A cap as defined in claim 1 wherein component parts, namely, said sliding tongue, said cap, and said folded part are integrally formed by means of injection molding.

5. A cap as defined in claim 2 wherein component parts, namely, said cover, said sliding tongue, and said folded part are integrally formed by means of injection molding.

6. A cap with a sliding-flap closure for a container, said cap comprising a pouring orifice formed in its top, said cap being defined in that it is provided with a closure in the form of a flap laid against said orifice, said flap comprising a tongue, the free front end of said tongue being designed to be capable of sliding longitudinally and being guided and pressed onto said orifice by means of slide tracks or slideways positioned laterally relative to said tongue, the rear end of said tongue being fixed to the top of said cap by means of a part folded in concertina form, said flap being associated by means of said folded part with a slotted plate which is located above said top of said cap and surmounts it and keeps it against the bottom of said slideways, said slotted plate being force-fitted by means of its peripheral edge into an upward projecting rim on said top of said cap, and a slot being disposed in said plate.

7. A cap as defined in claim 6 wherein said slotted plate is fixed to said top of said cap by means of a hinge part arranged in the extension of said slot on the opposite side of said tongue, said folded part of the latter starts from the bottom of said slot, and said slot is provided above and has a width slightly less than said folded part and said tongue.

* * * * *